United States Patent [19]

Bronnenhuber

[11] 4,300,113

[45] Nov. 10, 1981

[54] FUSED ELECTRIC PLUG

[76] Inventor: Rene Bronnenhuber, 124 Lakeside Dr., Piscataway, N.J. 08854

[21] Appl. No.: 73,081

[22] Filed: Sep. 6, 1979

[51] Int. Cl.[3] ..... H01H 85/02

[52] U.S. Cl. ..... 337/187; 337/198

[58] Field of Search ..... 337/187, 197, 198, 268

[56] References Cited

U.S. PATENT DOCUMENTS 2,644,056 6/1953 Curtis ..... 337/198

2,728,828 12/1955 Mason ..... 337/198

3,218,413 11/1965 Koch ..... 337/197

*Primary Examiner*—George Harris

*Attorney, Agent, or Firm*—Norman N. Popper; Daniel H. Bobis

[57] ABSTRACT

A fused electric plug having a removable cap between the electric prongs which may be unthreaded for the insertion of a fuse; the electric connector prongs extending from the plug housing are rigidly mounted on a prong holder which also holds a fuse socket in registration with an opposite tubular fuse socket.

1 Claim, 8 Drawing Figures

FIG. 1
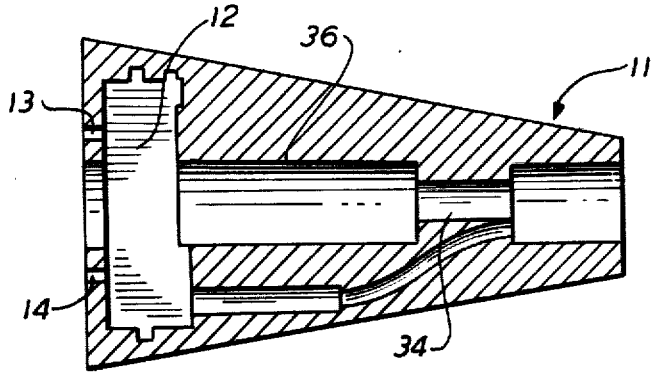
FIG. 2
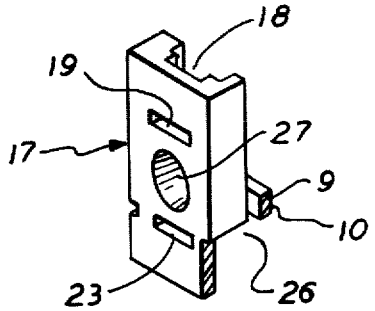
FIG. 3
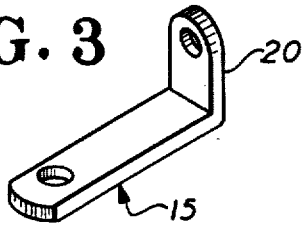
FIG. 4
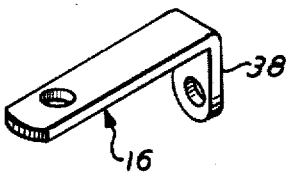
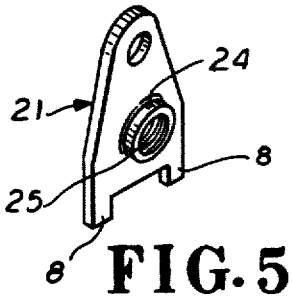
FIG. 5
FIG. 6
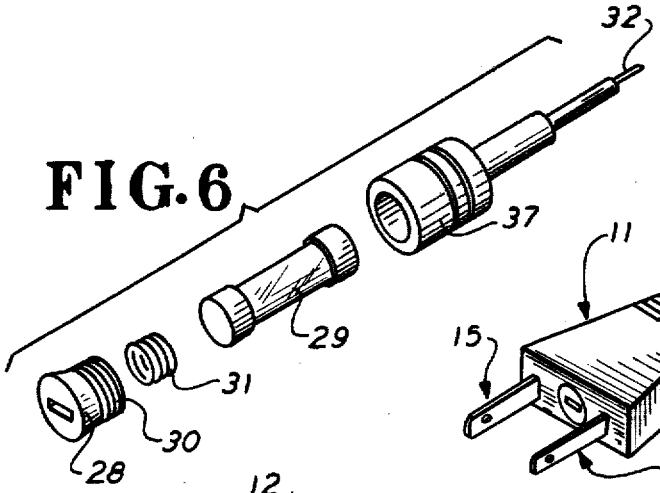
FIG. 8
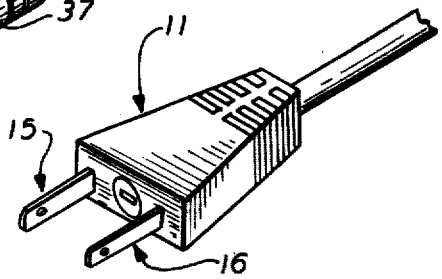
FIG. 7
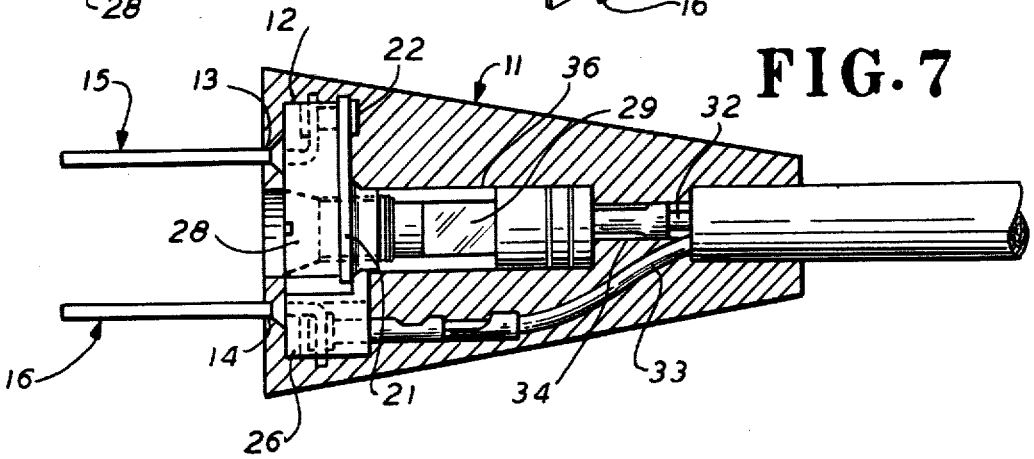

FUSED ELECTRIC PLUG

BACKGROUND OF THE INVENTION

1. Field of the Invention

This invention relates generally to fused electric plug connectors and particularly to such connectors wherein the prongs are rigidly mounted on a separate rigid prong holder which also serves to mount a fuse socket.

2. Prior Art

There have been numerous fused electrical connector plugs. The fuses have been difficult to insert and replace. The prongs have been easily deflectable so that their insertion in a socket has been difficult. The connection of the electric conductor wires has been involved with engagement under screws. The housing for the prongs has been detachable and subject to involuntary separation from the prongs. Some fused plug connectors have required that they be disassembled in order to remove or replace the enclosed fuse.

SUMMARY OF THE INVENTION

It has been found that a fused electric plug connector can be made which permits the easy removal or replacement of the fuse when it is spent or when a fuse of different value is required. Further, it has been found that the prongs of the plug can be separately mounted on a rigid block so that they are not subject to deflection. The present construction involves the permanent attachment of the electric conductor lead wires in the plug so that it is not necessary to attach the wires by screws which often may be ineffectively accomplished.

THE DRAWINGS

These objects and advantages as well as other objects and advantages may be obtained by the fused electric plug shown by way of illustration in the drawings in which:

FIG. 1 is a vertical sectional view of the plug housing;

FIG. 2 is a perspective view of a rigid prong holder to be inserted in the housing;

FIG. 3 and FIG. 4 are perspective views of the left and right-hand prongs which protrude from the plug housing;

FIG. 5 is a perspective view of the fuse socket holder;

FIG. 6 is an exploded view of the plug, the loading spring in the plug, the fuse, the tubular fuse socket connected with one of the electrical leads, all shown in spaced relation with each other to indicate their axial relationship in the fused plug;

FIG. 7 is a vertical sectional view of the plug with the components positioned therein;

FIG. 8 is a perspective view of the assembled plug.

PREFERRED EMBODIMENT

Referring now to the drawings in detail, the fused plug 11 provides a housing with a cavity 12 at one end. The cavity 12 has right and left slots 13, 14 immediately adjacent; these slots communicate from the cavity to the outside of the housing and provide the means for the passage of the right and left prongs 15, 16 from inside of the plug 11 to the outside. The plug 11 is made of dielectric material. A generally rectangular prong holder 17 as shown in FIG. 2 is dimensioned so as to be snugly held in the cavity 12 with the prongs 15, 16 mounted on the prong holder 17 extending through the right and left slots 13, 14. The prong holder 17 is made of rigid dielectric material such as plastic or hard rubber and the like so that when the prongs 15, 16 are positioned thereon, they will not be subject to deflection or deformation that might make it difficult to insert them in an outlet. The prong holder 17 has a cavity 18 which communicates with a passage 19. A first prong 15 is inserted in the passage 19 and protrudes therefrom and an offset portion 20 of the first prong 15 is seated in the cavity 18. A fuse socket holder 21 is attached to the offset portion 20 of the prong 15 by a rivet 22. There is a raised portion 10 on the prong holder 17. This raised portion 10 has an overhanging lip 9 under which is seated a pair of detents 8, 8 whereby, through the riveted attachment of the offset portion 20 of the prong 15, the fuse socket holder 21 is firmly anchored in place and the prong 15 rigidly secured. This construction ensures that the prong 15 is rigidly secured and not subject to deflection. In the enlargement 10, there is also a cavity 26 in which the prong 16, having an offset portion as later will be seen is seated.

The prong holder 17 also has a second slot 23 for the insertion of the second prong 16. This second prong 16 fits into an isolated cavity 26 in the prong holder 17. The prong holder 17 has a hole 27 punched in it, surrounded by a raised collar 24 defining a threaded portion for engagement with a plug. This enlargement 25 is in registration with a hole 27 in the prong holder 17 and permits the introduction of a fuse through the hole 27 in the prong holder 17 between the prongs 15, 16. A plug 28 is inserted in this hole. The plug 28 has a conductive portion 30 which is threaded and thus engage the threads 25 in the fuse socket holder 21. The removal of the plug 28 permits the exchange or insertion of a fuse 29. In the cup 30, a small spring is inserted to ensure the engagement of the fuse at both ends.

Wires 32, 33 for conducting power are introduced into the plug through an axial bore 34. The axial bore communicates with another larger concentric axial bore which defines the fuse chamber 36. One wire 32 is connected to a tubular socket 37 for holding one end of the fuse 29. Another wire 33 is connected to an offset portion 38 of the second prong 16. The connection of the conductor 33 to the offset 38 may be accomplished through frictional engagement with a lug attached to the offset portion 38 of the second prong 16. The wire 32 is connected to the tubular socket for the fuse by soldering it to the rear of the socket or some other appropriate means. A fuse 39 is provided. It is inserted through the threaded plug orifice to engage the tubular socket 37 at one end and it nestles in the metal conductive cup 30 secured to the plug 28 thereby making contact with the fuse socket holder which is attached to the offset portion 20 of the first prong 15. Replacement of the fuse 29 is easily accomplished by removal of the threaded plug 28.

What is claimed is:

1. A fused plug comprising, (a) a housing of dielectric material, (b) a hollow portion in the housing defining a passage for electric conductors and a means for holding a fuse, (c) an interior cavity in the housing for a prong holder at the other end of the housing dimensioned to closely receive and hold a prong holder, (d) a rigid prong holder in the prong holder cavity, (e) a pair of prong slots in the housing adjacent to the rigid prong holder, (f) a pair of prong slots in the prong holder, (g) a pair of prongs extending through the slots in the rigid prong holder and in the housing, (h) offset portions of the prongs engaged with the rigid prong holder, (i) an axial opening in the housing, (j) an axial opening in the rigid prong holder in registration with the opening in the housing and defining a fuse insertion passage positioned between the prongs, (k) a fuse socket holder, (l) bifurcated end portions of the fuse socket holder engaged with the rigid prong holder at one end and attached to the prong at the other end of the rigid prong holder, (m) a fuse socket attached to the fuse socket holder at the fuse passage, (n) the fuse socket having an internal thread, (o) a threaded plug for engagement with the fuse socket holder, (p) a portion of the plug electrically conductive at the threaded engagement portion, (q) a tubular socket opposite to the plug, (r) a first electric conductor connected to the tubular socket, (s) a second electric conductor in the housing connected to the second prong, (t) a fuse engaged at one end with the electrically conductive portion of the plug and at the opposite end with the tubular socket.

* * * * *